US006860054B1

(12) United States Patent
Mosher

(10) Patent No.: US 6,860,054 B1
(45) Date of Patent: Mar. 1, 2005

(54) PNEUMATIC GUN ALIGNMENT SYSTEM

(76) Inventor: Allan R. Mosher, P.O. Box 278, St. Albans Bay, VT (US) 05481

( * ) Notice: Subject to any disclaimer, the term of this patent is extended or adjusted under 35 U.S.C. 154(b) by 106 days.

(21) Appl. No.: 10/633,261

(22) Filed: Aug. 1, 2003

(51) Int. Cl.[7] ..... F41A 27/00
(52) U.S. Cl. ..... 42/94
(58) Field of Search ..... 42/94; 45/96

(56) References Cited

U.S. PATENT DOCUMENTS

| | | | | | |
|---|---|---|---|---|---|
| 2,991,579 | A | | 7/1961 | Lies | 42/94 |
| 3,012,350 | A | * | 12/1961 | Wold | 42/94 |
| 3,621,597 | A | | 11/1971 | Price | 42/94 |
| 4,702,235 | A | * | 10/1987 | Hong | 602/13 |
| 4,790,096 | A | | 12/1988 | Gibson et al. | 42/94 |
| 5,233,779 | A | * | 8/1993 | Shaw | 42/94 |
| 5,332,185 | A | | 7/1994 | Walker, III | 248/346 |
| 5,333,404 | A | * | 8/1994 | Lingyak | 42/72 |
| 5,333,829 | A | * | 8/1994 | Bell et al. | 248/634 |
| 5,406,653 | A | * | 4/1995 | Todor | 4/496 |
| 5,421,115 | A | | 6/1995 | McKay | 42/94 |
| 5,490,302 | A | * | 2/1996 | Dion | 15/210.1 |
| 5,603,131 | A | * | 2/1997 | DeJean, Jr. | 5/672 |
| 5,667,524 | A | * | 9/1997 | Bourgeois et al. | 606/202 |
| 5,819,461 | A | * | 10/1998 | Killian | 42/94 |
| 5,875,580 | A | * | 3/1999 | Hill et al. | 42/94 |
| 5,887,374 | A | | 3/1999 | Brass | 42/94 |
| 5,930,931 | A | | 8/1999 | Watson | 42/94 |
| 5,954,676 | A | * | 9/1999 | Kramer, III | 602/6 |
| 6,681,974 | B2 | * | 1/2004 | Rotter | 224/662 |
| 2002/0040544 | A1 | | 4/2002 | Muhlestein | 42/94 |
| 2003/0094474 | A1 | * | 5/2003 | Rotter | 224/662 |
| 2003/0114765 | A1 | * | 6/2003 | Lia et al | 600/491 |
| 2003/0139673 | A1 | * | 7/2003 | Vivenzio et al. | 600/490 |
| 2003/0199922 | A1 | * | 10/2003 | Buckman | 606/202 |

FOREIGN PATENT DOCUMENTS

| | | | | |
|---|---|---|---|---|
| DE | 32 04082 a1 | * | 8/1983 | F41G/3/32 |

* cited by examiner

*Primary Examiner*—Jack Kath
*Assistant Examiner*—Troy Chambers

(57) ABSTRACT

A pneumatic gun alignment system for accurately adjusting a gun position. The pneumatic gun alignment system includes a support bag having an air bag positionable beneath a firearm, and an air supply fluidly connected to the air bag for supplying pressurized air to the air bag. A valve unit is preferably positioned within the hose for allowing the user to slowly release air from the air bag and for maintaining a desired amount of air within the air bag. The user increases the air pressure to elevate the firearm and decreases the air pressure to lower the firearm.

6 Claims, 5 Drawing Sheets

PNEUMATIC GUN ALIGNMENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to gun supports and more specifically it relates to a pneumatic gun alignment system for accurately adjusting a gun position.

2. Description of the Related Art

Gun supports have been in use for years for assisting shooters with aiming their firearms. A typical gun support (12) is shown in FIGS. 4*a* through 5*c* of the drawings. A typical gun support has a base with a threaded shaft threadably extending vertically from within base and a support platform that supports the firearm. The gun support may be utilized on the front or the rear of the firearm to adjust the angle of the firearm. Sandbags and similar devices are positioned upon the support platform for providing additional adjustment of the firearm.

The main problem with conventional gun supports is that they require the user to rotate the threaded shaft to adjust the vertical position of the support platform thereby disrupting the shooter's concentration. Another problem with conventional gun supports is that they do not accurately adjust the attitude of the gun for shooting.

While these devices may be suitable for the particular purpose to which they address, they are not as suitable for accurately adjusting a gun position. Conventional gun supports do not accurately or conveniently allow for the adjustment of the rifle for aiming at a target.

In these respects, the pneumatic gun alignment system according to the present invention substantially departs from the conventional concepts and designs of the prior art, and in so doing provides an apparatus primarily developed for the purpose of accurately adjusting a gun position.

BRIEF SUMMARY OF THE INVENTION

In view of the foregoing disadvantages inherent in the known types of gun supports now present in the prior art, the present invention provides a new pneumatic gun alignment system construction wherein the same can be utilized for accurately adjusting a gun position.

The general purpose of the present invention, which will be described subsequently in greater detail, is to provide a new pneumatic gun alignment system that has many of the advantages of the gun supports mentioned heretofore and many novel features that result in a new pneumatic gun alignment system which is not anticipated, rendered obvious, suggested, or even implied by any of the prior art gun supports, either alone or in any combination thereof.

To attain this, the present invention generally comprises a support bag having an air bag positionable beneath a firearm, and an air supply fluidly connected to the air bag for supplying pressurized air to the air bag. A valve unit is preferably positioned within the hose for allowing the user to slowly release air from the air bag and for maintaining a desired amount of air within the air bag. The user increases the air pressure to elevate the firearm and decreases the air pressure to lower the firearm.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable Of other embodiments and of being practiced and carried out in various ways. Also, it is to be understood that the phraseology and terminology employed herein are for the purpose of the description and should not be regarded as limiting.

A primary object of the present invention is to provide a pneumatic gun alignment system that will overcome the shortcomings of the prior art devices.

A second object is to provide a pneumatic gun alignment system for accurately adjusting a gun position.

Another object is to provide a pneumatic gun alignment system that does not require the shooter to lose their concentration when adjusting a firearm.

An additional object is to provide a pneumatic gun alignment system that allows the shooter to remain focused upon the target while simultaneously adjusting the gun position.

A further object is to provide a pneumatic gun alignment system that may be utilized in conjunction with conventional gun supports for aligning a rifle.

Another object is to provide a pneumatic gun alignment system that is lightweight and compact in size.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
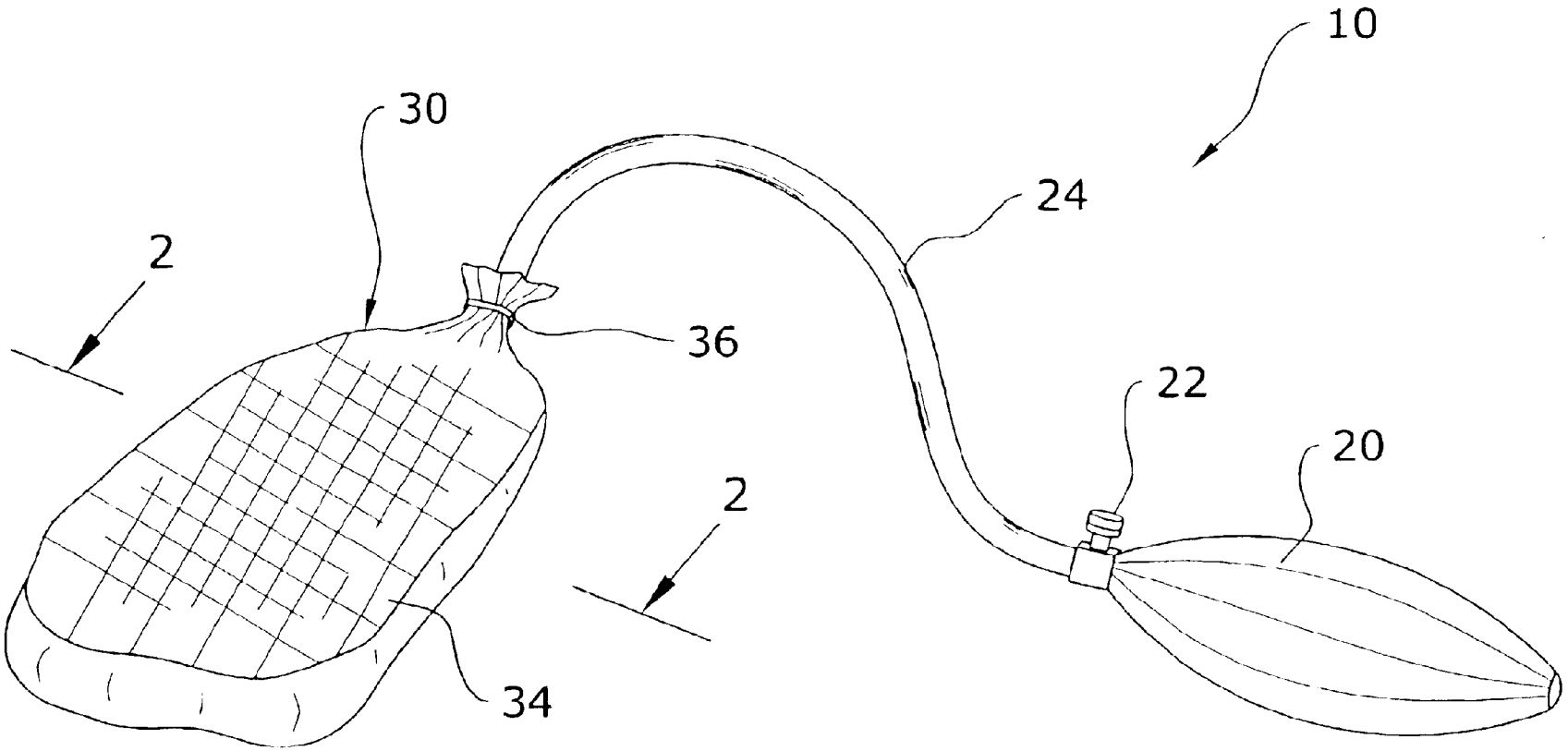
FIG. 1 is an upper perspective view of the present invention.

Turning now descriptively to the drawings, in which similar reference characters denote similar elements throughout the several views, FIGS. 1 through 5*c* illustrate a pneumatic gun alignment system 10, which comprises a support bag 30 having an air bag 32 positionable beneath a firearm 16, and an air supply fluidly connected to the air bag 32 for supplying pressurized air to the air bag 32. A valve unit 22 is preferably positioned within the hose 24 for allowing the user to slowly release air from the air bag 32 and for maintaining a desired amount of air within the air bag 32. The user increases the air pressure to elevate the firearm 16 and decreases the air pressure to lower the firearm 16.

B. Support Bag

FIGS. 1 through 5*c* illustrate the support bag 30. The support bag 30 is inflatable and is positionable beneath a firearm 16 (rear portion or front portion) for adjusting the position of a firearm 16. The support bag 30 may be comprised of various structures other than illustrated in FIGS. 1 through 5*c* of the drawings.

Figure 2:
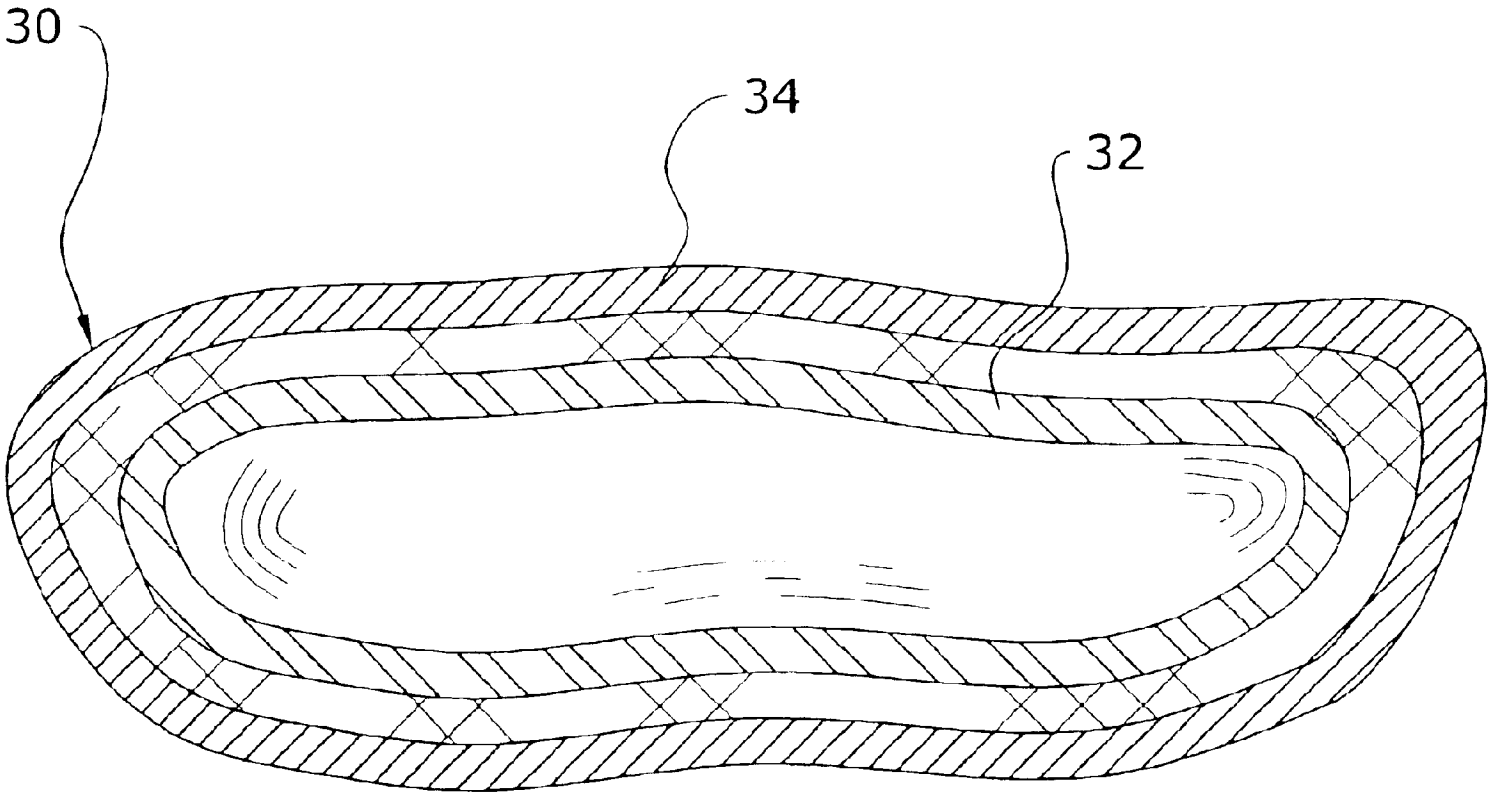
FIG. 2 is a cross sectional view taken along line 2—2 of FIG. 1.

As shown in FIG. 2 of the drawings, the support bag 30 is preferably comprised of an air bag 32 and a removable cover 34 surrounding the air bag 32. The air bag 32 is comprised of a flexible and non-permeable material, such as but not limited to rubber, for retaining a volume of air under pressure. As shown in FIG. 2 of the drawings, the air bag 32 has a relatively flat upper surface and relatively flat lower surface when inflated.

The cover 34 is comprised of a permeable material such as but not limited to cloth. The cover 34 is secured and closed about the hose 24 by a tie member 36 thereby forming a neck structure as shown in FIG. 1 of the drawings.

C. Hose

An elongate hose 24 is fluidly connected between the support bag 30 and an air supply unit 20. The elongate hose 24 is preferably flexible for allowing positioning of the air supply unit 20 in various positions and locations.

D. Valve Unit

A valve unit 22 is preferably positioned within the hose 24 for allowing control of airflow within the hose 24. The valve unit 22 allows for closing of airflow from the support bag 30 (i.e. thereby maintaining a desired air pressure within the support bag 30). The valve unit 22 also allows for releasing of airflow from the support bag 30. The valve unit 22 may be comprised of various valve structures commonly utilized.

E. Air Supply Unit

Figure 3B:
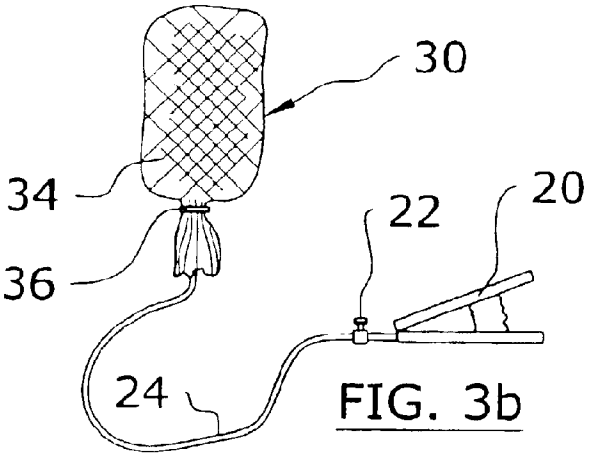
FIG. 3*b* is a side view of the present invention utilizing a foot pump.
Figure 3A:
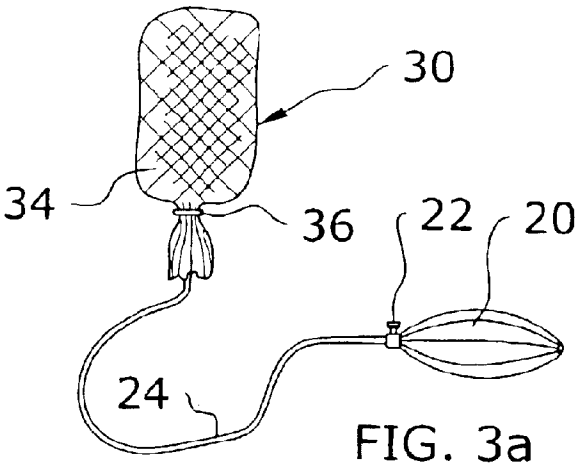
FIG. 3*a* is a side view of the present invention utilizing a hand pump.
Figure 3C:
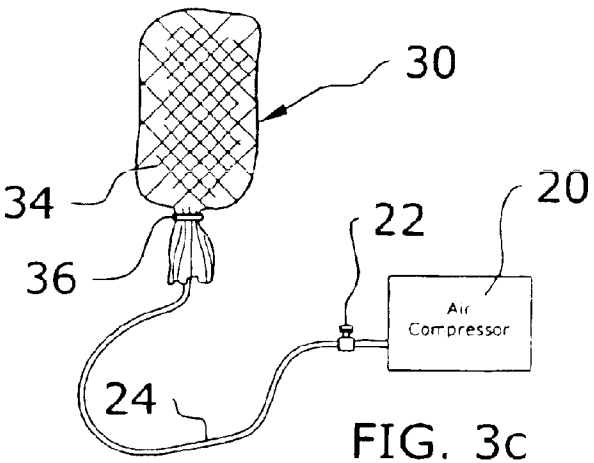
FIG. 3*c* is a side view of the present invention utilizing an air compressor.

The air supply unit 20 is preferably a manually operated structure capable of providing pressurized air such as but not limited to a hand operated or foot operated device as shown in FIGS. 3*a* and 3*b* of the drawings. Alternatively, the air supply unit 20 is a mechanically operated structure capable of providing pressurized air as shown in FIG. 3*c* of the drawings.

F. Operation—Front Position

Figure 4A:
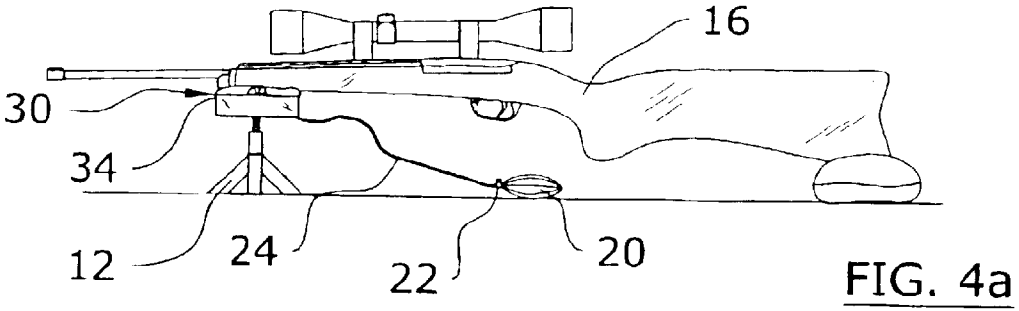
FIG. 4*a* is a side view of the present invention adjustably supporting a front portion of a gun in a deflated state.
Figure 4B:
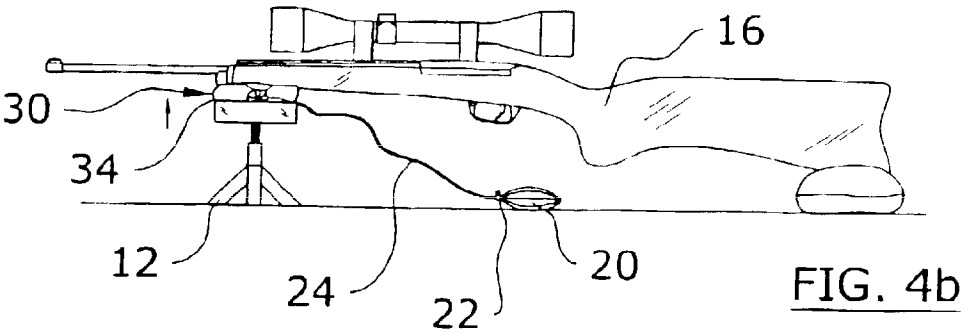
FIG. 4*b* is a side view of the present invention adjustably supporting a front portion of a gun in a partially inflated state.
Figure 4C:
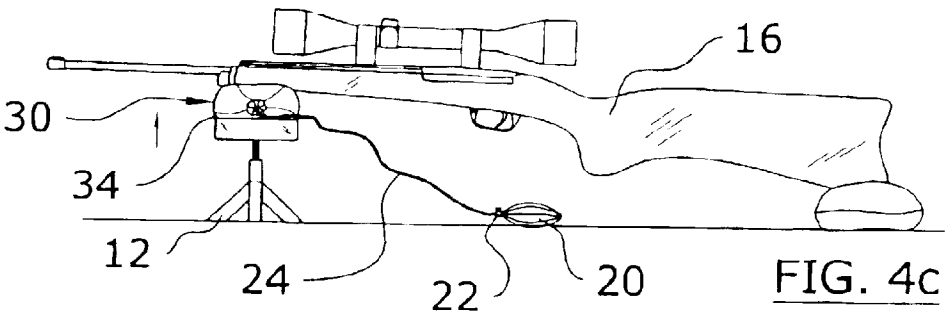
FIG. 4*c* is a side view of the present invention adjustably supporting a front portion of a gun in a inflated state.

In operation of the present invention positioned beneath a front position of a firearm 16, the support bag 30 is positioned beneath a front portion of a firearm 16 as shown in FIGS. 4*a* through 4*c* of the drawings. The support bag 30 may be positioned upon a conventional gun support 12 and/or sandbag 14 as shown in FIGS. 4*a* through 4*c* of the drawings. In addition, a sandbag 14 or other support may be positioned beneath the rear portion of the firearm 16 as shown in FIGS. 4*a* through 4*c*.

If an increase in angle is required for the firearm 16, the user increases the air pressure within the support bag 30 thereby expanding the support bag 30 and increasing the vertical position of the front portion of the firearm 16 as shown in FIGS. 4*b* and 4*c* of the drawings. The user increases the air pressure until the desired angle of the firearm 16 is achieved.

If a decrease in angle is required for the firearm 16, the user decreases the air pressure within the support bag 30 thereby reducing the size of the support bag 30 and reducing the vertical position of the front portion of the firearm 16 as shown in FIG. 4*a* of the drawings. The user decreases the air pressure until the desired angle of the firearm 16 is achieved.

The valve unit 22 is closed when the desire angle for the firearm 16 is reached. The user then fires the firearm 16 at the target when desired.

G. Operation—Rear Position

Figures 5A, 5B, 5C:
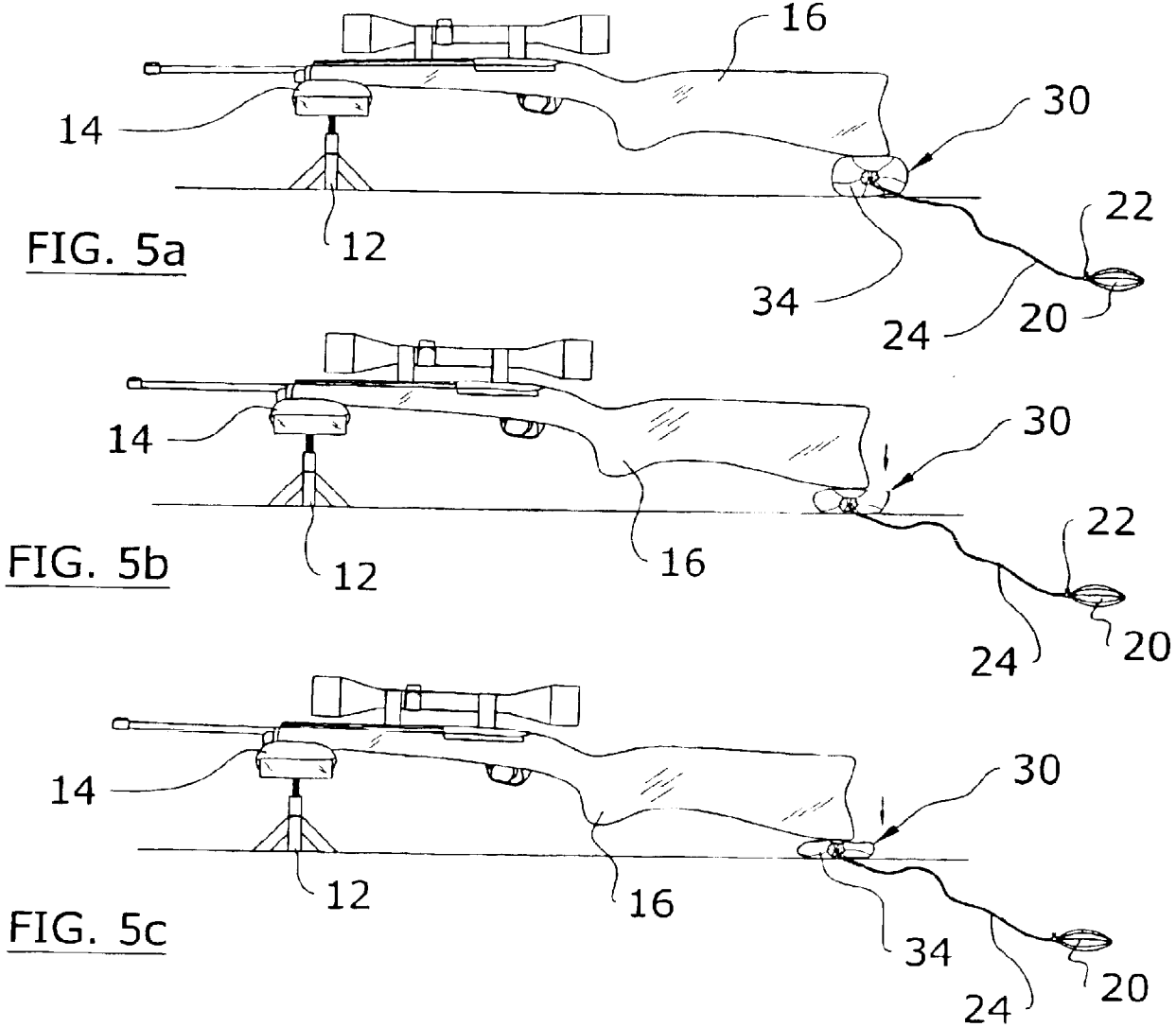
FIG. 5*a* is a side view of the present invention adjustably supporting a rear portion of a gun in an inflated state.
FIG. 5*b* is a side view of the present invention adjustably supporting a rear portion of a gun in a partially deflated state.
FIG. 5*c* is a side view of the present invention adjustably supporting a rear portion of a gun in a deflated state.

In operation of the present invention positioned beneath a rear position of a firearm 16, the support bag 30 is positioned beneath a rear portion of a firearm 16 as shown in FIGS. 5*a* through 5*c* of the drawings. A conventional gun support 12 and/or sandbag 14 may be positioned beneath the front portion of the firearm 16 as shown in FIGS. 5*a* through 5*c* of the drawings.

If an increase in angle is required for the firearm 16, the user decreases the air pressure within the support bag 30 thereby reducing the size of the support bag 30 and decreasing the vertical position of the rear portion of the firearm 16 as shown in FIGS. 5*b* and 5*c* of the drawings. The user decreases the air pressure until the desired angle of the firearm 16 is achieved.

If a decrease in angle is required for the firearm 16, the user increases the air pressure within the support bag 30 thereby expanding the size of the support bag 30 and increasing the vertical position of the rear portion of the firearm 16 as shown in FIG. 5*a* of the drawings. The user increases the air pressure until the desired angle of the firearm 16 is achieved.

The valve unit 22 is closed when the desire angle for the firearm 16 is reached. The user then fires the firearm 16 at the target when desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of operating a pneumatic gun alignment system, said method comprising the steps of:

(a) positioning an inflatable support bag beneath a front portion of a firearm;

(b) increasing air pressure within said support bag if an increase in angle is required for said firearm;

(c) decreasing air pressure within said support bag if a decrease in angle is required for said firearm; and (d) maintaining a relatively constant air pressure within said support bag if a desired angle is achieved for said firearm.

2. The method of operating a pneumatic gun alignment system of claim 1, wherein said support bag is positioned upon a gun support.

3. The method of operating a pneumatic gun alignment system of claim 1, including a sandbag positioned beneath a rear portion of said firearm.

4. A method of operating a pneumatic gun alignment system, said method comprising the steps of:

(a) positioning an inflatable support bag beneath a rear portion of a firearm;

(b) decreasing air pressure within said support bag if an increase in angle is required for said firearm;

(c) increasing air pressure within said support bag if a decrease in angle is required for said firearm; and (d) maintaining a relatively constant air pressure within said support bag is a desired angle is achieved for said firearm.

5. The method of operating a pneumatic gun alignment system of claim 4, wherein said support bag is positioned upon a gun support.

6. The method of operating a pneumatic gun alignment system of claim 4, including a sandbag positioned beneath a front portion of said firearm.

* * * * *